United States Patent [19]

Strunc

[11] 4,436,008

[45] Mar. 13, 1984

[54] PHOTOGRAPHIC FILM WEB CUTTER AND METHOD

[75] Inventor: Gerald R. Strunc, Maple Grove, Minn.

[73] Assignee: Pako Corporation, Minneapolis, Minn.

[21] Appl. No.: 365,284

[22] Filed: Apr. 5, 1982

[51] Int. Cl.[3] ..... B26D 5/24

[52] U.S. Cl. ..... 83/42; 83/210; 83/364; 83/371

[58] Field of Search ..... 83/42, 208–212, 83/364, 371

[56] References Cited

U.S. PATENT DOCUMENTS

| | | | |
|---|---|---|---|
| 4,056,024 | 11/1977 | Baert et al. | 83/210 |
| 4,114,349 | 9/1978 | Jensen et al. | 53/54 |
| 4,139,978 | 2/1979 | Jensen et al. | 53/167 |
| 4,139,980 | 2/1979 | Larson et al. | 53/520 |

*Primary Examiner*—James M. Meister

*Attorney, Agent, or Firm*—Kinney, Lange, Braddock, Westman and Fairbairn

[57] ABSTRACT

A photographic film cutter for cutting film segments from a web of photographic film includes a knife located along a web advancement path, a splice sensor located upstream from the knife, and a notch sensor located between the knife and the splice sensor. A stepper motor moves the web along the path in fixed length steps. A step counter counts the steps to determine the length that the web has advanced since the web was cut by the knife. When a splice is detected by the splice sensor, a maximum feed switch determines, based upon the count of the step counter, whether the distance from a leading cut edge to the splice sensor is greater than or equal to a predetermined maximum distance. If the length is less than the maximum, the web is advanced until a portion of the web adjacent the splice is positioned at the knife, and the web is cut. If the length from the cut edge to the splice is greater than the predetermined maximum length, an additional cut is made. A minimum feed switch determines if the distance from the leading cut edge to the knife is greater than a predetermined minimum. A notch distance verifier determines whether notches marking the film are normally spaced, and if so, the web is cut between frames. If a normal notch is not found, the web is advanced by an additional step count before cutting to assure that no frame is bisected by the knife.

12 Claims, 10 Drawing Figures

SPLICE SENSOR
34
70
74e
72e
NOTCH SENSOR
28
74d
72d
KNIFE
20
74c
72c
74b
72b
74a
72a
$d_1$

SPLICE SENSOR
34
70
74e
72e
NOTCH SENSOR
28
74d
72d
KNIFE
20
74c
72c
74b
72b
74a
72a
$d_1$

KNIFE
NOTCH SENSOR
SPLICE SENSOR
20
28
34
90
94a
94b
94d
92a
92b
92c
92d
96
98
$d_3$
$d_4$

KNIFE
NOTCH SENSOR
SPLICE SENSOR
20
28
34
90
94a
94b
94c
94d
92a
92b
92c
92d
96
98
$d_5$

KNIFE
NOTCH SENSOR
SPLICE SENSOR
20
28
34
110
114a
114b
112a
112b
116
118
120
$d_6$
$d_7$

KNIFE
NOTCH SENSOR
SPLICE SENSOR
20
28
34
110
114a
114b
112a
112b
118
120
$d_8$
$d_9$

PHOTOGRAPHIC FILM WEB CUTTER AND METHOD

BACKGROUND OF THE INVENTION

1. Field of the Invention

This invention relates to a photographic film cutter. In particular, the invention relates to a cutter for use in cutting individual film segments within a predetermined minimum and maximum length.

2. Description of the Prior Art

In commercial film processors, many separate films are spliced into a long web and processed together, in order to achieve a high processing rate and to maintain consistent quality. Once printed, the film must be cut into individual segments and packaged for return to the customer. An example of a web advancement and cutting mechanism is disclosed in U.S. Pat. No. 4,056,024 to Baert and Harvey, issued Nov. 1, 1977, assigned to Pako Corporation, assignee of the present application.

In order to properly pack the individual segments, it is important that the length of the segments is within certain size limits. This is especially important in automatic packing devices such as the Pako Photopacker automatic packing system, manufactured by Pako Corporation. The following U.S. Pat. Nos. illustrate portions of the Pako Photopacker automatic packing system: 4,114,349 by G. A. Jensen, L. A. Larson and R. E. Diesch; 4,139,978 by G. A. Jensen and A. J. Willenbring; and 4,139,980 by L. A. Larson and R. E. Diesch; all of which are assigned to Pako Corporation.

In some film formats, such as 110 or 126, the film is prenotched in relation to the frames, so that processing and cutting can be uniformly accomplished. In other film formats, such as 135 format, the film is not notched during the manufacturing process. Frames may appear anywhere along the film, depending on the camera design and the advancement of the film during use of the camera. The film is normally notched after it is developed in order to facilitate automatic alignment of frames of the film in the print gate of a photographic printer. It is difficult to ensure that this film with variable frame spacing is properly cut for insertion into the customer's package.

For example, packaging equipment specifies a maximum length of either three or four frames of 135 format film. In addition, automatic equipment will not work properly on segments of film shorter than a certain minimum length. For example, a piece shorter than an average frame (or approximately one and one-half inches), cannot be properly handled by automatic feeding apparatus. Even more importantly, in film that is not pre-notched by the manufacturer, it is critical that the cutting apparatus cut between frames so as not to destroy any of the customer's photographs.

The proper cutting becomes critical when a splice between individual films is reached. Prior art photographic film cutters can leave short pieces which cannot be properly or easily handled.

SUMMARY OF THE INVENTION

The present invention is a photographic film cutter which includes knife means, stationed along a feed path of longitudinal advancement of a web of spliced lengths of photographic film, for cutting a segment of the web extending past the knife means. A web advance means advances the web along the feed path between successive actuations of the knife means. A splice sensing means positioned prior to the knife means along the feed path senses a splice in the web. A notch sensing means positioned between the the knife means and the splice sensing means along the feed path senses notches in the web and provides a notch signal indicative of the sensing of a notch.

The cutter is provided with length sensing means, responsive to the web advance means, for providing a signal indicative of a first length of the web from its leading cut end to the sensed splice. Control means are provided for controlling the web advance means based upon the length sensing means signal, the splice signal, and the notch signal so that each segment cut by the knife means has a length less than or equal to a predetermined maximum length and greater than a predetermined minimum length. The control means causes the web means to advance the web to a position with a portion of the web adjacent the splice in alignment with the knife means if, based upon the length signal, the first length is less than the maximum predetermined length. The control means causes the web advance means to advance the web a total feed length determined by the notch signal and the length signal if the first length is greater than the maximum length.

The web advance means preferably includes a stepper motor, controlled by a stepper motor driver, and a stepper motor pulse generator which generates a step pulse signal to activate the stepper motor driver for each step that the stepper motor is to advance the web.

The length sensing means preferably includes a step counter for accumulating a step count of step pulse signals indicating the steps that the stepper motor has advanced the web. A maximum feed switch preferably determines whether the step signal from the step counter indicates that the maximum length has been reached.

A notch distance verifier, responsive to the notch sensing means preferably determines if spacing between successive notches is standard. Interframe cut logic preferably advances the web an additional step count if the notch distance verifier determines that the distance is not standard.

DETAILED DESCRIPTION OF THE PREFERRED EMBODIMENTS

Figure 1A:
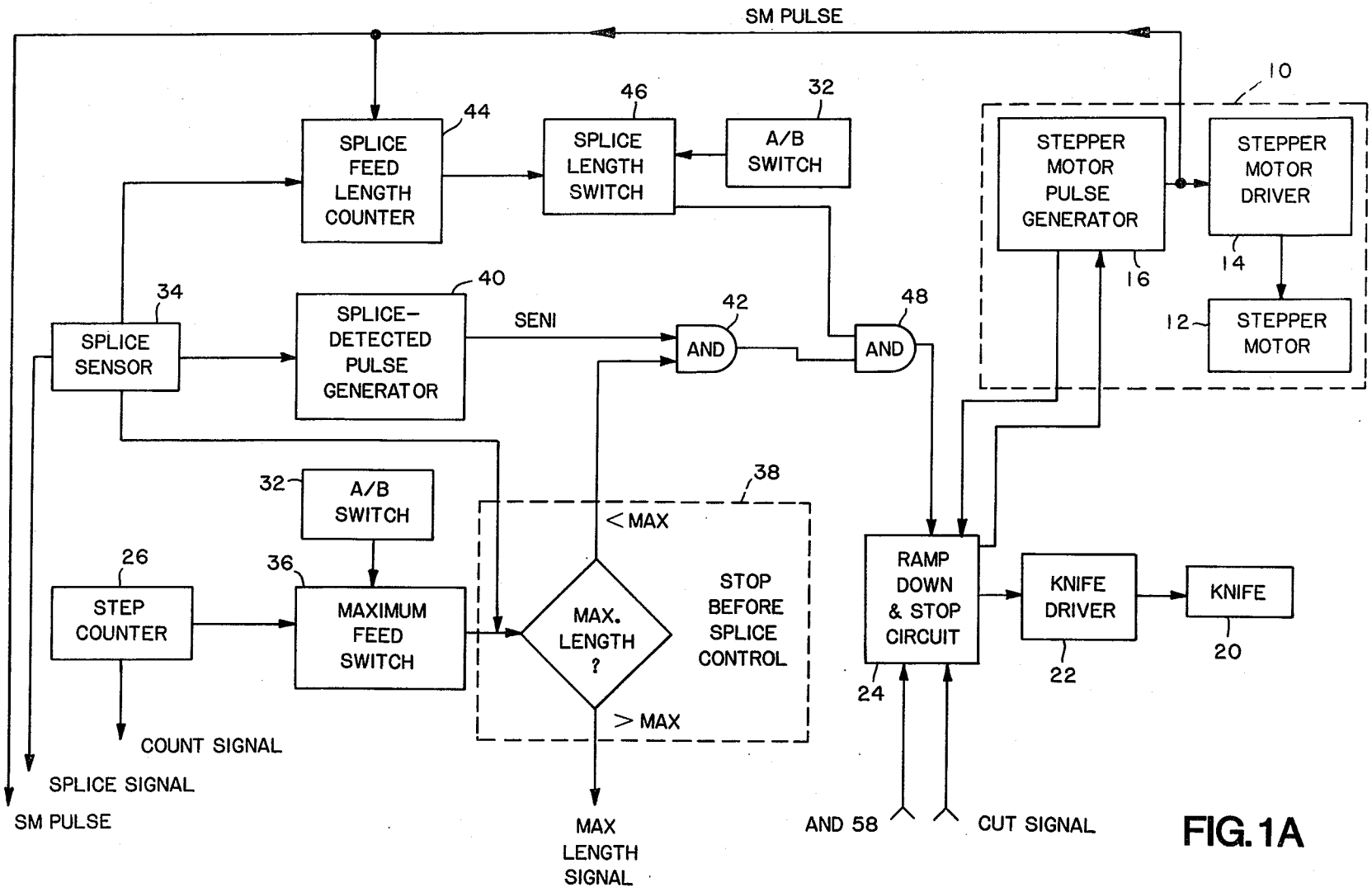
FIGS. 1A and 1B are an electrical block diagram of a film cutter constructed according to the present invention.
Figure 1B:
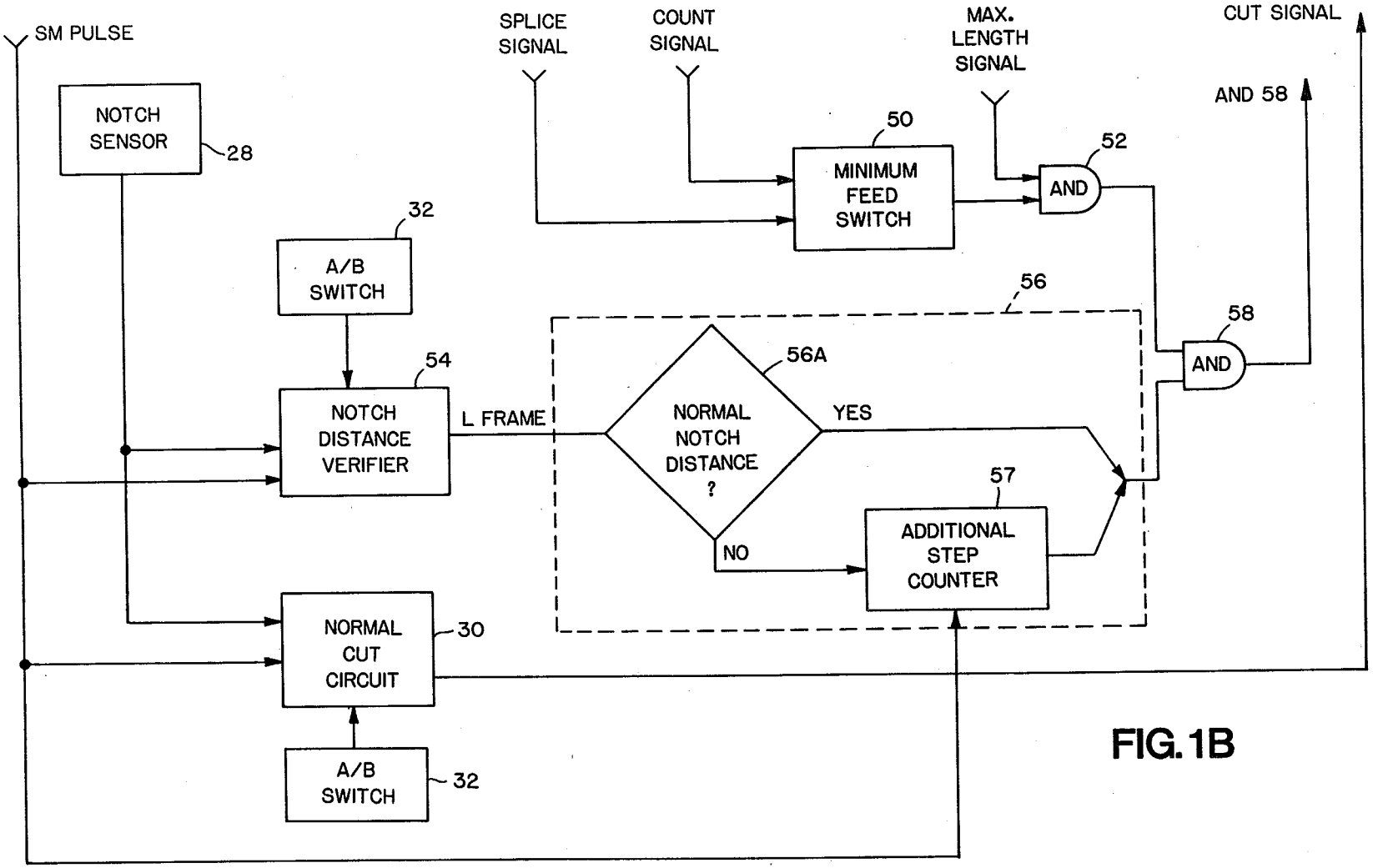

As shown in the electrical block diagram of FIGS. 1A and 1B, a photographic film cutter for cutting segments of film from a web of processed photographic film has a web advance means 10 which includes a stepper motor 12, stepper motor driver 14, and stepper motor pulse generator 16. The stepper motor 12 moves the web along a film feed path in steps, in this example, of 0.012 inches. For each step that stepper motor 12 is to move the web, stepper motor pulse generator 16 generates an electrical step pulse signal. Stepper motor driver 14 receives the electrical step pulse signals from stepper motor pulse generator 16 and activates stepper motor 12.

Knife means for cutting the web include a knife 20 and a knife driver 22, which contains circuitry to activate knife 20.

A ramp down and stop circuit 24 is activated whenever the web is to be cut. Circuit 24 slows down the movement of the web by stepper motor 12 and activates knife driver 22 when the web is stopped, so that the web is cut by knife 20. Web advance means 10, knife 20, knife driver 22, and ramp down and stop circuit 24 are all conventional components found in prior art photographic film cutters.

A step counter 26 receives the electrical step pulse signals (SM pulse) from stepper motor pulse generator 16. The signals represent steps that the web has been advanced by stepper motor 12. Step counter 26 counts these step pulse signals and totals the number of steps the web has been advanced since the last activation of knife 20. Step counter 26 is reset to zero each time knife 20 cuts the web.

A notch sensor 28, upsteam from knife 20 along the path of advance of web, senses frame-indicating notches on the edge of the web. The type of photographic film to which the present invention relates has variable frame spacing, depending on the type of camera which exposed the film and the way in which the user advanced the film in the camera. For example, 135 format film is exposed in varying configurations. Each frame has a notch, made during a previous step in the processing of the film, which marks the location of the frame. Notch sensor 28 senses these notches and generates an electrical signal indicating that a notch has been sensed. Notch sensor 28 is a conventional component such as used in the prior art photographic film cutters.

In normal film cutting operation, the cutter illustrated in FIG. 1 operates in the fashion of prior art film cutters. A normal cut circuit 30 receives signals from step counter 26 indicating the distance that stepper motor 12 has moved the web. When the web has moved a predetermined distance, normal cut circuit 30 responds to the next notch signal from notch sensor 28. When a notch is sensed, normal cut circuit 30 provides a CUT signal which activates ramp down and stop circuit 24, which moves the web until knife 20 is positioned after the frame to which the sensed notch corresponds. Knife driver 22 is activated to cause knife 20 to cut the web. The predetermined distance measured by normal cut circuit 30, in the example illustrated, has two possible values. The film cutter is preset by service technicians with a "A" value and a "B" value. An operator uses an A/B switch 32 to select between these two values.

For example, one common length of film cut is 6.22 inches, which represents four frames of 135 format (35 mm) film. After the web has moved a distance of more than three frames, normal cut circuit 30 responds the next notch signal from notch sensor 28. This notch represents the fourth frame. Normal cut circuit 30 then activates ramp down and stop circuit 24 to move the web into position so that knife 20 can cut off a four-frame segment from the leading end of the web. This part of the film cutter operates in the same manner as prior art film cutters. In this embodiment, step counter 26 consists of a pair of binary counters which are cascaded to contain an eight-bit value.

The present invention particularly relates to the situation when a splice is encountered and the normal cutting of segments of film is disrupted. The cutter is provided with a splice sensor 34, upstream from the notch sensor along the feed path of the web, for sensing the splice in the web and generating a SPLICE signal indicative of the sensed splice. In order to ensure that no section of film exceeds a predetermined maximum length or is less than a predetermined minimum length, the cutter includes means for sensing the distance from a leading cut edge of the web to the knife and the distance from the leading edge to splice sensor 34. A maximum feed switch 36 contains a preset value against which the count in step counter 26 is component. In the example illustrated, maximum feed switch 34 contains two parallel sets of switches, one each for the A and B settings. One of the two sets is selected based on input from A/B switch 32.

Each switch is a dual-inline-package (DIP) switch which holds a four-bit value. A set of two switches is used for the eight-bit A value and a set of two switches is used for the eight-bit B value. The switches are set so that all eight bits in the switches must have a high value to signify that the count in step counter 26 has reached a maximum feed length. The switch is set so that the distance from the knife 20 to splice sensor 34, which is constant, is subtracted from the maximum allowable predetermined distance. The remainder is the distance the web extends past knife 20 when the maximum predetermined distance has been fed. The value representing this remainder is stored in maximum feed switch 36 and is compared to the count in step counter 26.

When the maximum value A or B is reached, all bits in the respective set of DIP switches are high. When all bits in the set of switches are high, maximum feed switch 36 generates a high maximum feed signal which represents the occurrence of a maximum feed length.

This high value is supplied to stop before splice control circuit 38. Stop before splice control circuit 38 contains a decision means, such as a flip flop, which receives the maximum feed signal from maximum feed switch 36 and puts out an intermediate feed signal, internal to stop before splice circuit 38, which is high if the maximum feed has not been reached and low if the maximum feed has been reached. Stop before splice control circuit 38 receives the splice signal from splice sensor 34. If a splice has been detected, stop before spice control circuit 38, based on the intermediate feed signal, puts out either a less-than-maximum signal, if the maximum feed has not occurred, or an equal-to-or-greater-than-maximum signal if the maximum feed has occurred.

If the feed is less than the maximum, for example 6.22 inches, the web is to be advanced so that the knife 20 is aligned adjacent the detected splice. Therefore, each time a splice is sensed by splice sensor 34 a splice signal is provided to a splice detected pulse generator 40, which in this example is a pair of flip flops, which produces a pulse signal if a splice is detected. This signal is called SENI.

The SENI signal and the less-than-maximum signal from stop before splice control circuit 38 are ANDed by AND gate 42. The resulting signal indicates that signals from notch sensor 28 are to be ignoredand that, when the web is advanced to align knife 20 with a location adjacent the splice, knife 20 is to be activated.

A splice feed length counter 44 receives signals from stepper motor pulse generator 16, with which it counts the distance that the web has advanced since the splice was detected. Each sensing of the splice by splice sensor 34 removes the reset from splice feed length counter 44. Splice feed length counter 44 generates a splice feed count signal, representing the count of steps the web has advanced. The distance from splice sensor 34 to knife 20 is preset in splice length switch 46. In this example, two alternative values are set, one of which is selected in response to A/B switch 32. A pair of hexadecimal switches represents each eight-bit value. Splice length switch 46 compares the preset value with the splice feed count signal. The bits in the switches are high when the signal from splice feed length counter 44 equals the preset value in splice length switch 46, which represents the distance between knife 20 and splice sensor 34. Splice length switch 46 puts out a signal when the appropriate bits are high. The signals from the stop before splice switch 46 and from AND gate 42 are ANDed by AND gate 48. The signal from AND gate 48 activates ramp down and stop circuit 24. Once ramp down and stop circuit 24 is activated, the cutter operates in the same manner as it did for the cutting of normal lengths of film.

When the greater-than-maximum signal from stop before splice control circuit 38 signifies that the length of film from the leading edge to the splice sensor 34 is greater than the maximum predetermined distance, the cutter must ensure that, since an additional cut is needed before the splice, the length of the web cut is longer than the minimum distance. A minimum feed switch 50 receives the splice signal from splice sensor 34 indicating that a splice has been sensed. Minimum feed switch 50 then receives count signals from step counter 26. Minimum feed switch 50 includes decision means, such as a flip flop, to respond to the count signal. When the count signal indicates the minimum feed has occurred, the decision means produces an intermediate minimum feed signal. If the splice signal has been received, minimum feed switch 50 then puts out a high value minimum feed signal indicating that the minimum feed has been exceeded. This minimum feed signal from minimum feed switch 50 is ANDed with the signal from stop before splice control circuit 38, which indicates that the feed from the leading edge to the splice was over the maximum distance. These signals are ANDed by AND gate 52.

In order to safely cut the web without damaging any photographic image, the cutter must ensure that no frame will be bisected. A notch distance verifier 54 receives a signal from notch sensor 28 for each notch sensed. Notch distance verifier 54 has two parallel paths, one for the A switch setting and one for the B switch setting. Each path has a pair of binary counters (not shown). The pair of counters stores the distance from the last notch sensed, based on step signals received from step counter 26. A hexadecimal switch (not shown) is set with a value representing the number of steps equal to one frame length, for example one and one-half inches for standard 135 format frames. When all bits in one path's switches are not high, notch distance verifier 54 causes its output notch distance signal, called LFRAME, to be high indicating that the correct interframe spacing length was reached.

The normal state is that notches are sequentially sensed and the counters are continually reset, so that the maximum is never reached. Therefore, the resultant LFRAME signal is usually high. If the maximum distance from notch to notch is reached without a notch being sensed by notch sensor 28, all bits in path's switches are high. Notch distance verifier 54 then causes LFRAME to go low, signifying that no notch was found.

The LFRAME signal is provided to interframe cut logic 56. Interframe cut logic 56 contains an additional pair of binary counters (not shown) within logic 56A. When LFRAME is high, the counters are continually reset and never begin counting. This produces a signal to a YES output branch of logic 56A which is ANDed by AND gate 58 with a signal from AND gate 52. The resulting signal is supplied to the ramp down and stop circuit 24 to slow down the web and activate the knife 20 in normal fashion.

If LFRAME goes low it means that no notch was sensed and that there is an abnormality in frame spacing. For example, it may be that there are no frames at the end of a particular piece of film. In order to ensure that it is safe to cut, an additional feed is needed. The NO output branch of logic 56A enables additional step counter 57 to begin counting an additional feed. When the additional feed (such as 0.188 inches) has occurred, it is safe to cut and a signal is generated and provided to AND gate 58 and, in turn, to ramp down and stop circuit 24.

When the distance from the leading edge to the splice has been found by stop before splice control 38 to be greater than the maximum, and the web has been advanced as above and cut, the distance from the cut to the splice is now less than the normal length cut by normal cut circuit 30. The SENI signal from splice detected pulse generator 40 is still high. Maximum length has not been found by stop before splice control 38, so the less-than-maximum signal is present. This signal is ANDed with SENI by AND gate 42.

Splice feed length counter 44 is still counting, since the splice has not reached the knife. Web advance means 10 advances the web until the splice feed count signal from splice feed length counter 44 is found by splice length switch 46 to be equal to the distance between splice sensor 34 and knife 20. Splice length switch 46 puts out its signal which is ANDed by AND gate 48 with the signal from AND gate 42. As a result, the signal from AND gate 48 activates ramp down stop circuit 24 to make the next cut in the web when the splice reaches the knife.

Figure 2A:
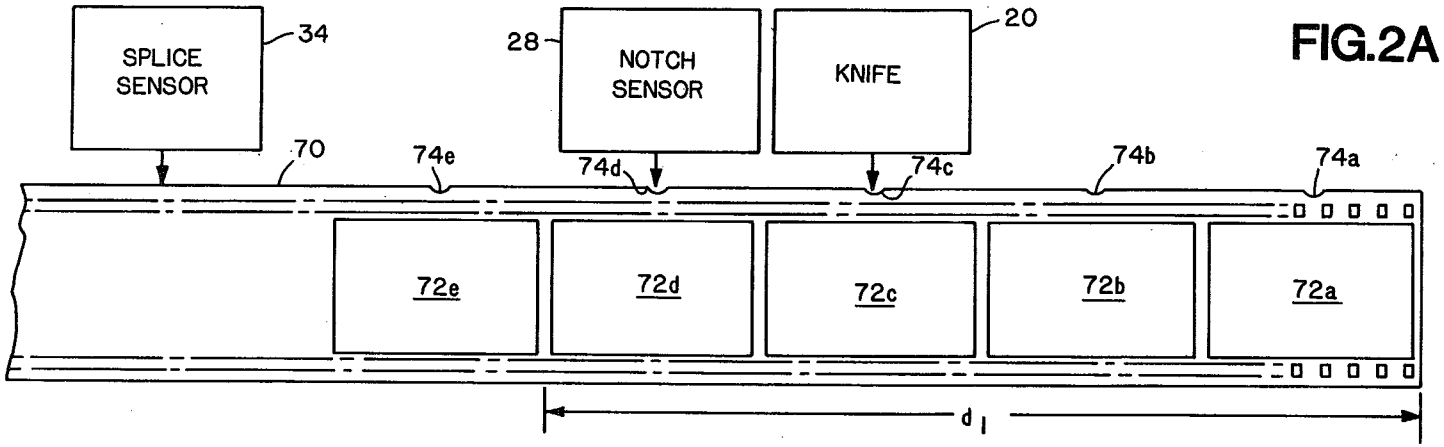
FIG. 2A is a partially schematic view of a web of film positioned adjacent a splice sensor, notch sensor and knife of the film cutter.
Figure 2B:
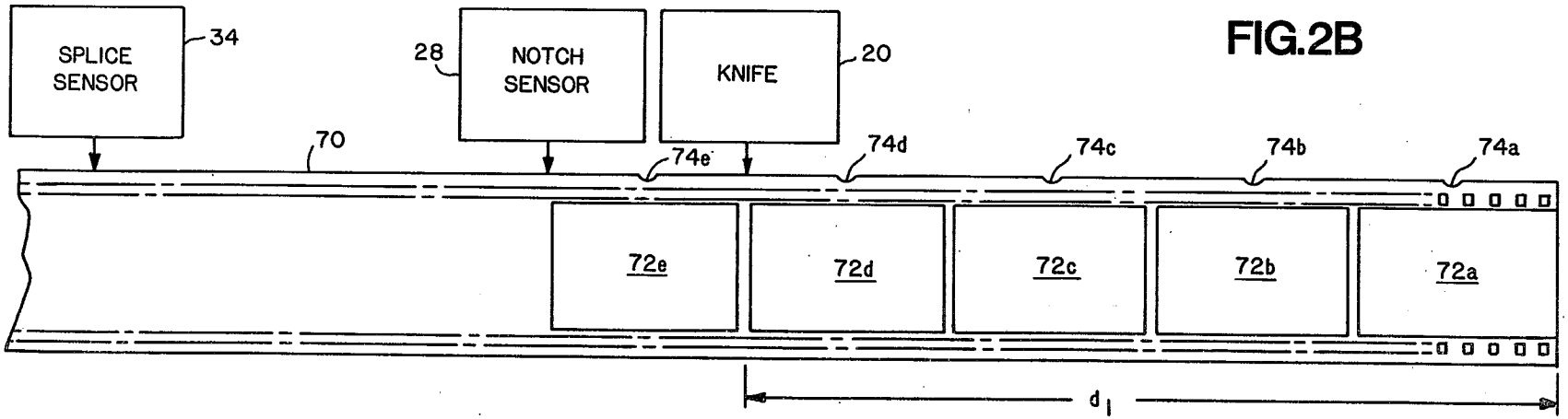
FIG. 2B is a partially schematic view of the web of FIG. 2A advanced to a position for cutting by the knife.

The operation of the cutter can be illustrated by showing relative web positions along the web path, as in FIGS. 2A–5B, where webs are shown moving from left to right. FIG. 2A shows a web 70 with frames 72*a–e*, which are marked by notches 74*a–e*, respectively. No splice has yet reached splice sensor 34. In this example, four frames, equal in length to distance $d_1$, will be considered the normal length to cut. Since three frames, 72*a*, 72*b*, and 72*c* have passed notch sensor 28, normal cut circuit 30 now responds to notch sensor 28 when notch 74*d* is detected. Therefore, ramp down and stop circuit 24 is activated to move web 70 until frame 72*d* is positioned past knife 20. The web is then cut between frames 72*d* and 72*e*. This provides a normal four-frame section of length $d_1$.

Figure 3A:
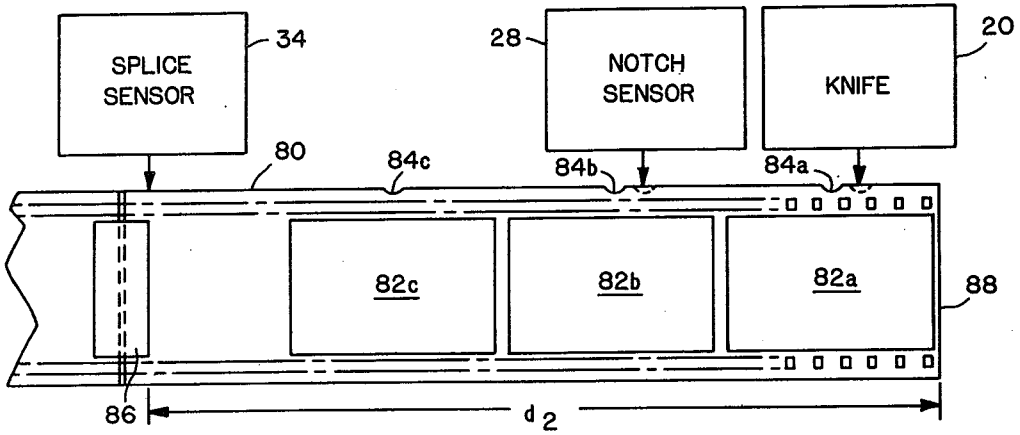
FIG. 3A is a partially schematic view of a web of film positioned in the film cutter for a splice to be sensed by a splice sensor.
Figure 3B:
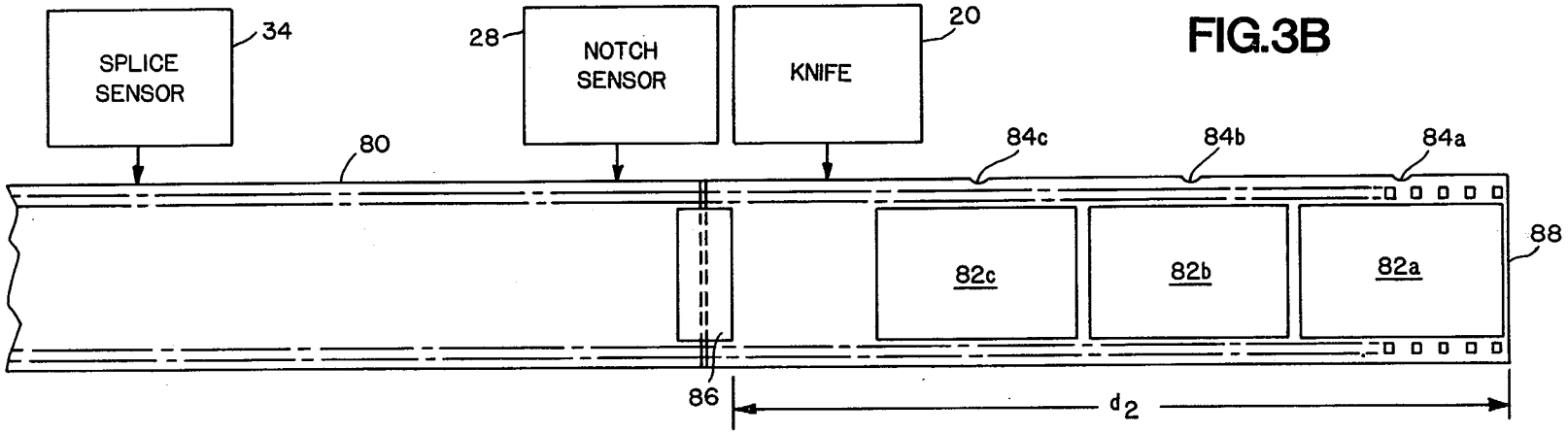
FIG. 3B is a partially schematic view of the web of FIG. 3A advanced to position for cutting by the knife.

In FIG. 3A a web 80 has frames 82*a–c*, marked by notches 84*a–c*, respectively. A splice 86 is positioned adjacent to and detected by splice sensor 34. A distance $d_2$ from a leading edge 88 to splice sensor 34 is less than the predetermined maximum distance, which is equivalent to four frames. Therefore, stop before splice control circuit 38 generates the less-than-maximum signal indicating that the distance is less than the maximum.

Splice detected pulse generator 40 generates its signal when splice sensor 34 has detected a splice. This is ANDed with the signal from stop before splice control circuit 38 by AND gate 42. Web 80 is advanced to the position shown in FIG. 3B. The count of steps in this movement in splice feed length counter 44 is found to be the distance from splice sensor 34 to knife 20 by stop before splice switch 46. The stop before splice switch 46 creates a signal which is ANDed with the signal from AND gate 42 by AND gate 48. This activates the ramp down and stop circuit 24 to advance and cut the web 80 adjacent splice 86. In this example, where the distance $d_2$ from leading edge 88 to splice 86 was less than the predetermined maximum, notch signals, indicating that notches 84*a–c* are sensed, are ignored.

Figure 4A:
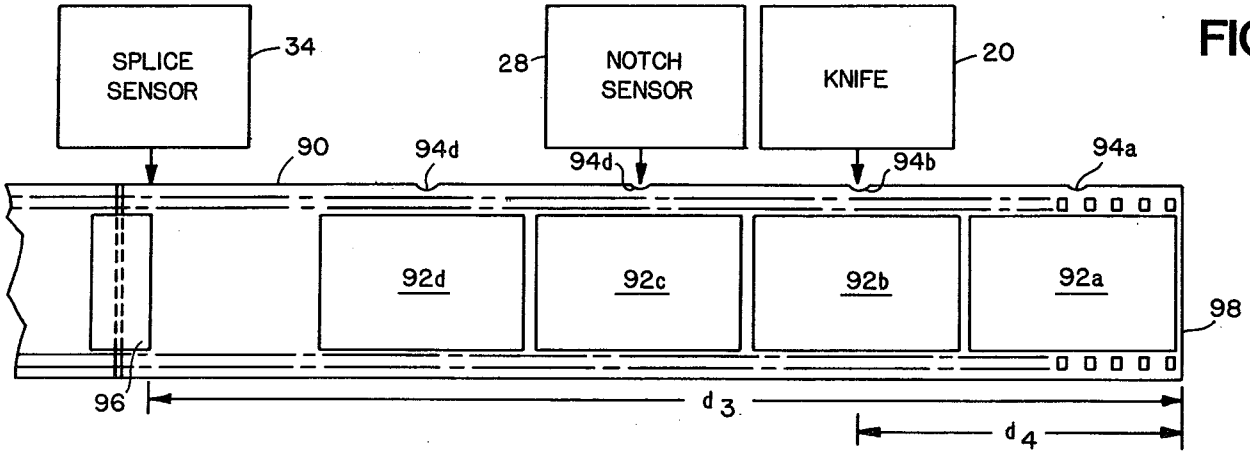
FIG. 4A is a partially schematic view of a web of film positioned in the film cutter for a splice to be sensed by a splice sensor with a notch sensed by the notch sensor.
Figure 4B:
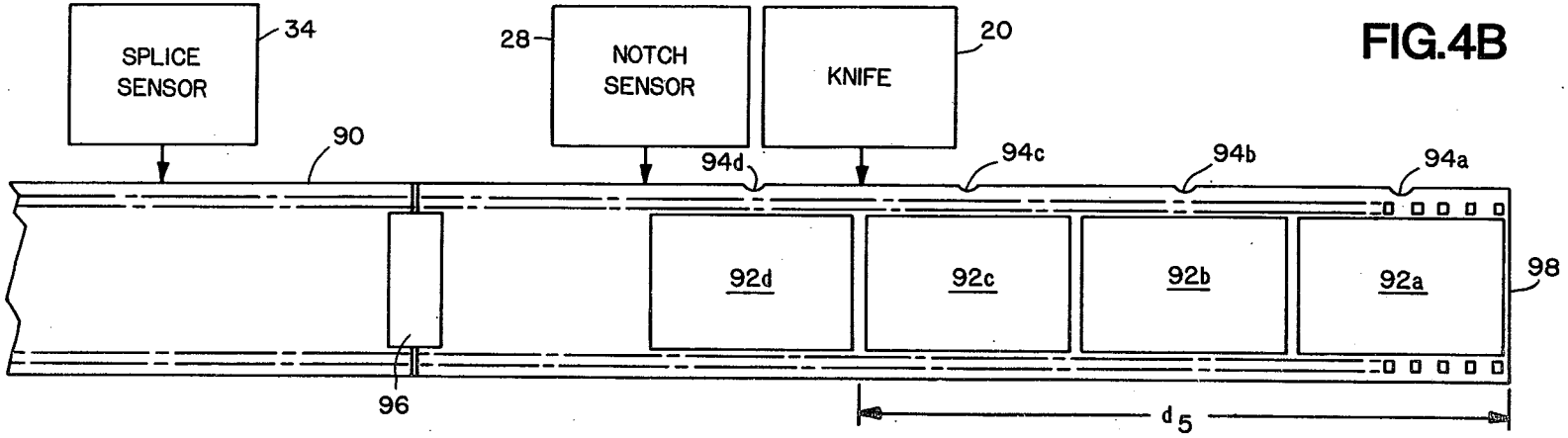
FIG. 4B is a partially schematic view of the web of FIG. 4A advanced to position the knife between the frames for cutting.

In FIG. 4A a web 90 has frames 92*a–d*, which are marked by notches 94*a–d*, respectively. A splice 96 is in position to be detected by splice sensor 34. The distance $d_3$ from leading edge 98 to splice 96 is determined by stop before splice control circuit 38 to be greater than the predetermined maximum. Minimum feed switch 50 determines that the minimum feed has occurred, since a distance $d_4$ greater than the width of frame 92*a*, has moved past knife 20. Notch sensor 28 senses notch 94*c* which marks frame 92*c*. The distance from notch 94*b* to notch 94*c* is determined by the notch distance verifier 54 to be the proper distance. Therefore, ramp down and stop circuit 24 is activated to move web 90 to the position shown in FIG. 4B where it is cut between frames 92*c* and 92*d* by knife 20, so that the segment cut is equal in length to distance $d_5$. During the next advance and cut cycle, web 90 will be advanced until knife 20 is aligned with a portion of web 90 adjacent splice 96, and knife 20 will be activated. In the example shown in FIGS. 4A and 4B, the portion of the web having length $d_3$ is severed into two sections, both of which are less than a predetermined maximum length and greater than a predetermined minimum length.

Figure 5A:
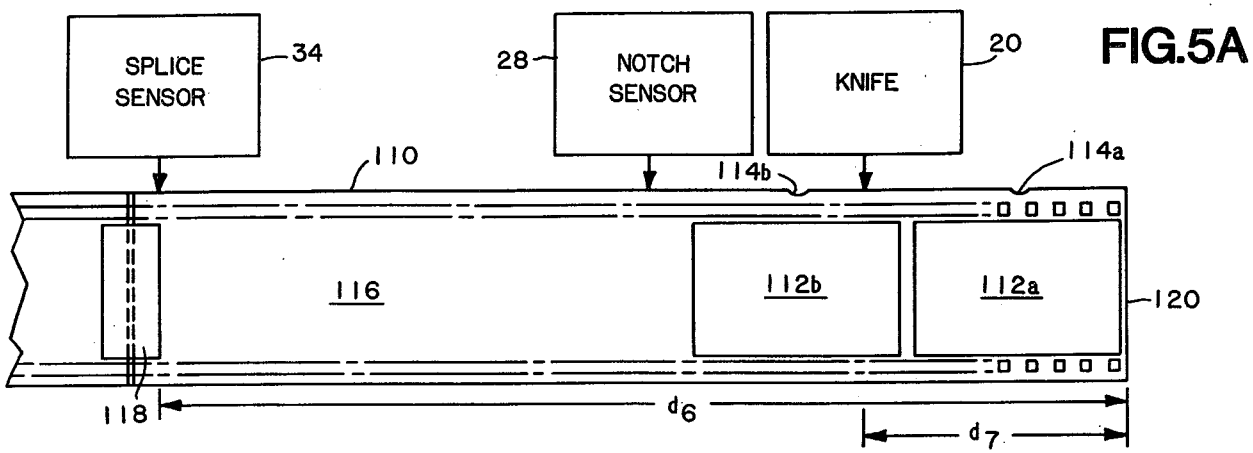
FIG. 5A is a partially schematic view of a web with a splice positioned for sensing by the splice sensor with no frames remaining between the position of the notch sensor and the splice sensor.
Figure 5B:
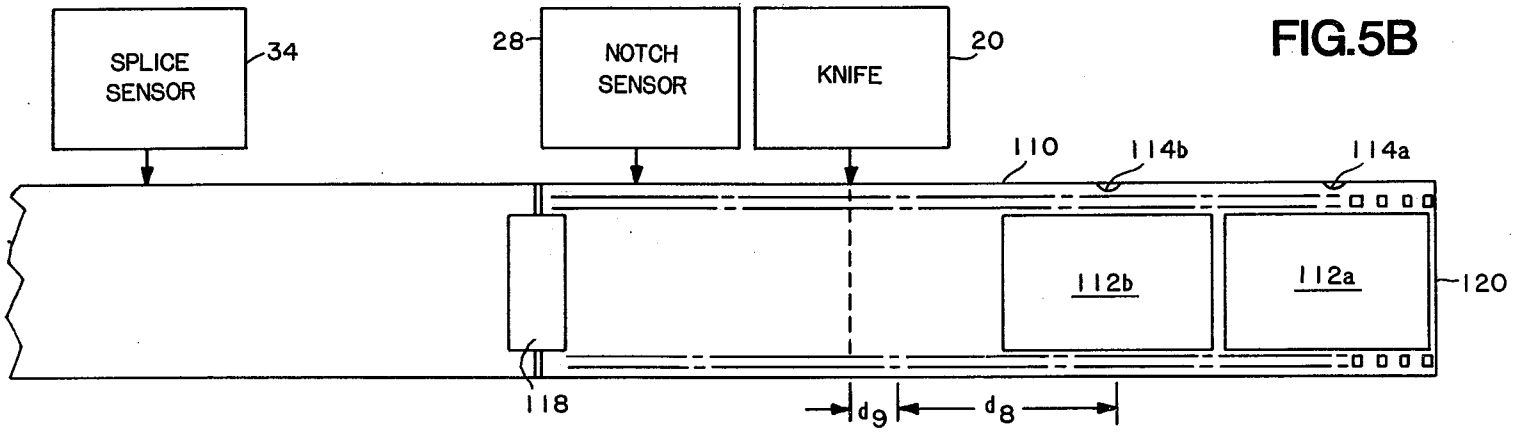
FIG. 5B is a partially schematic view of the web of FIG. 5A advanced to position to be cut by the knife.

In FIG. 5A, a web 110 has frames 112*a* and 112*b*, marked by notches 114*a* and 114*b*, respectively. A trailing area 116 has no frames and therefore no notches. A splice 18 is shown in position to be detected by splice sensor 34. A distance $d_6$ from a leading edge 120 to splice 118 is found by maximum feed switch circuit control 36 to be greater than the predetermined maximum. Minimum feed switch 50 determines that a minimum feed $d_7$ has passed knife 20, since frame 112*a* has moved past knife 20. Notch distance verifier 54 finds no notch following notch 112*b* as web 110 advances the normal frame length. The normal notch distance is shown as $d_8$. Therefore, interframe cut logic 56 begins counting as the web moves an extra distance $d_9$, in this example 0.188 inches, to check to see if a notch is detected. Since none is, ramp down and stop circuit 24 is activated to move web 110 to the position shown in FIG. 5B where it is cut by knife 20.

The film cutter constructed according to the present invention ensures, through this control logic, that no segment of film is smaller than a predetermined minimum distance. It also ensures that no section adjacent a detected splice is larger than a predetermined maximum distance. This solves the problem encountered in prior art devices of properly cutting the area of the web adjacent a splice.

Although the present invention has been described with reference to preferred embodiments, workers skilled in the art will recognize that changes may be made in form and detail without departing from the spirit and scope of the invention.

What is claimed:

1. A photographic film cutter for cutting segments from a web of spliced lengths of photographic film, the web containing notches for indicating location of variable spaced frames, the photographic film cutter comprising:

an intermittently activable knife means stationed along a feed path of longitudinal advancement of the web for cutting a segment extending past the knife means from the web;

web advance means for advancing the web along the feed path between successive actuations of the knife means;

splice sensing means positioned prior to the knife means along the feed path for sensing a splice in the web and for generating a splice signal indicative of the sensing of the splice;

length sensing means responsive to web advance means for providing a first length signal indicative of a first length of the web from its leading end to the sensed splice and a second length signal indicative of a second length of the web from its leading edge to the knife means;

notch sensing means positioned prior to the knife means along the feed path for sensing notches in the web and providing a notch signal indicative of sensing of a notch; and control means for controlling the web advance means based upon the first length signal, the splice signal, and the notch signal so that each segment cut has a length less than or equal to a predetermined maximum length and greater than a predetermined minimum length, the control means causing the web advance means to advance the web to a position with a portion of the web adjacent the splice in alignment with the knife means if, based upon the first length signal, the first length is less than the maximum length, and the control means causing the web advance means to advance the web a total feed length determined by the notch signal and the second length signal if the first length is greater than the maximum length.

2. The photographic film cutter of claim 1 wherein the web advance means advances the web in fixed-length steps, and wherein the length sensing means includes a step counter for generating a count signal indicative of the number of steps the web has been advanced.

3. The photographic film cutter of claim 2 wherein the web advance means includes:

a stepper motor for advancing the web in fixed-length steps;

a stepper motor pulse generator for generating a step pulse signal for each step that the stepper motor is to advance the web; and a stepper motor driver for activating the stepper motor to advance the web one step for each pulse signal.

4. The photographic film cutter of claim 2 wherein the length sensing means further includes:

maximum feed switch, responsive to the count signal from the step counter, for comparing the count signal to a predetermined stored maximum count and for generating a feed signal having a first state indicating that the count signal has reached the maximum predetermined count and a second state indicating that the count signal has not reached the predetermined maximum count.

5. The photgraphic film cutter of claim 2 wherein the control means includes:

a splice feed length counter, responsive to the web advance means and a splice sensing means, for providing a second count signal indicative of a third length of the web advanced since the splice was sensed; and splice length switch means, responsive to the count signal for generating a splice feed signal indicating that the web has advanced a length equal to the distance between the knife means and the splice sensing means.

6. The photographic film cutter of claim 2 wherein the control means includes:

notch distance verifier means, responsive to the notch sensing means and step counter, for determining a notch distance between successive notches in the web and for generating a notch distance signal indicative of whether the notch distance is equal to a predetermined notch distance.

7. The photographic film cutter of claim 6 wherein the control means further includes:

interframe cut logic, responsive to the notch distance signal, for comparing the notch distance signal to a stored predetermined notch distance and for activating the web advance means to advance the web an additional fourth distance if the notch distance signal is not equal to the predetermined notch distance.

8. The photographic film cutter of claim 2 wherein the control means further includes:

a minimum feed switch, responsive to the step counter and the splice sensing means, for storing a predetermined minimum feed value and for generating a minimum feed signal if the length the web has advanced is equal to or greater than the predetermined minimum feed value.

9. A method of cutting a photographic film web made of spliced lengths of notched film with variable frame spacing into sections with a knife located at a fixed knife position along a feed path, the method comprising:

(a) advancing the web along a feed path so that a leading end of the web extends past the fixed knife position;

(b) sensing a splice in the web at a splice sensing position upstream from the fixed knife position; P1

(c) determining a first length of web from a cut end to to the splice;

(d) if the first length to the splice is less than a predetermined maximum length, advancing the web until a portion of the web adjacent the splice is aligned with the fixed knife position and activating the knife to cut a segment extending past the fixed knife position from the web; and (e) if the first length of the splice is greater than the predetermined maximum length, advancing the web a second length so that a portion of the web greater than a predetermined minimum length from the cut end is aligned with the fixed knife position, and cutting the web.

10. The method of claim 9 wherein step (e) comprises:

activating a notch sensor located at a notch sensing position between the splice sensing position and the fixed knife position to sense a location of a frame;

if a frame location is sensed by the notch sensor, advancing the web a length so that the portion of the web aligned with the fixed knife position is between frames, and is greater than a predetermined minimum length from the cut end, and cutting the web; and if no frame is located, advancing the web a fourth length so that the portion of the web, which is aligned with the fixed knife position is greater than the predetermined minimum length from the cut end and cutting the web.

11. The method of claim 9 wherein:

advancing the web includes stepping the web in fixed steps; and determining a first length includes counting steps by counting step pulses indicating steps that the web has advanced.

12. The method of claim 9 wherein step (e) includes:

determining a fifth length of web from the cut end to the fixed knife position.

* * * * *